US006019484A

United States Patent [19]

Seyler

[11] Patent Number: 6,019,484

[45] Date of Patent: Feb. 1, 2000

[54] PORTABLE TASK LIGHTING DEVICE

[76] Inventor: Christopher M. Seyler, 1118 Solana Ave., Winter Park, Fla. 32789

[21] Appl. No.: 09/123,150

[22] Filed: Jul. 27, 1998

[51] Int. Cl.[7] ..... F21V 9/00

[52] U.S. Cl. ..... 362/287; 362/403; 362/413; 362/419

[58] Field of Search ..... 362/220, 285, 362/287, 401, 403, 413, 414, 419, 428, 486; 356/371, 237; 248/129, 151, 149, 164, 415, 431, 188.7

[56] References Cited

U.S. PATENT DOCUMENTS

| | | | |
|---|---|---|---|
| 4,463,413 | 7/1984 | Shirley | 362/401 |
| 4,803,606 | 2/1989 | Rotter | 362/250 |
| 5,448,464 | 9/1995 | Moss | 362/401 |
| 5,675,417 | 10/1997 | Ventura | 356/371 |

*Primary Examiner*—Cassandra Spyrou
*Assistant Examiner*—Leo Boutsikaris
*Attorney, Agent, or Firm*—Dorothy S. Morse

[57] ABSTRACT

A portable task lighting device which comprises an elongated fluorescent light assembly that casts a broad, glare-free, and cool flood of light and is rotatably connected to the distal end of a boom arm for a full 360° of rotation. Its boom arm can be fixed into a plurality of positive locking positions both above and below the top of its mast by adjustment of a pivot block supported by the mast. The preferred embodiment of the lighting device has a telescoping mast with a square cross-sectional configuration. The mast supports the proximal end of the boom arm and provides extension between approximately thirty-two and ninety inches. The mast is supported by a base assembly having two shorter rear legs which are adjustable laterally relative to one another and two elongated front legs which are locked into position at a predetermined stationary angle by insertion of the mast within a square opening through the top of the base assembly. Thus the lighting device of the present invention is adjustable into an infinite number of positions, and in addition it is configured to be quickly and easily collapsed into a compact configuration by the removal of one quick-release pin and the loosening of several quick-release clamping devices that secure the mast and rear legs in place during use. Applications may include, but are not limited to, use for a wide variety of light-sensitive work projects that for proper completion require a direct source of shadow-free lighting.

17 Claims, 4 Drawing Sheets

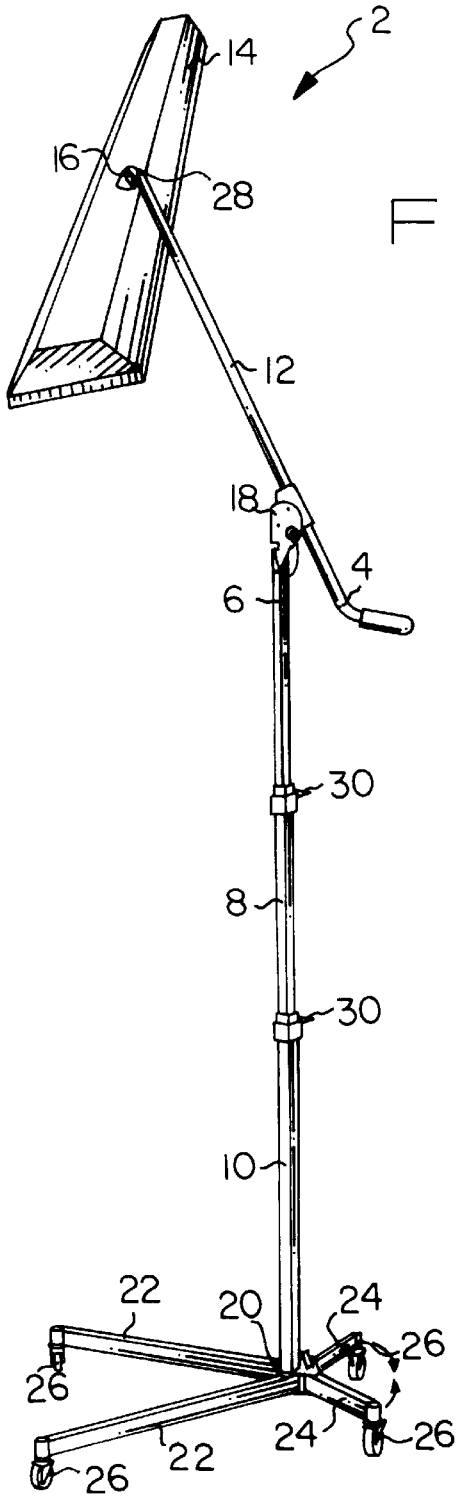
FIG.4
FIG.5
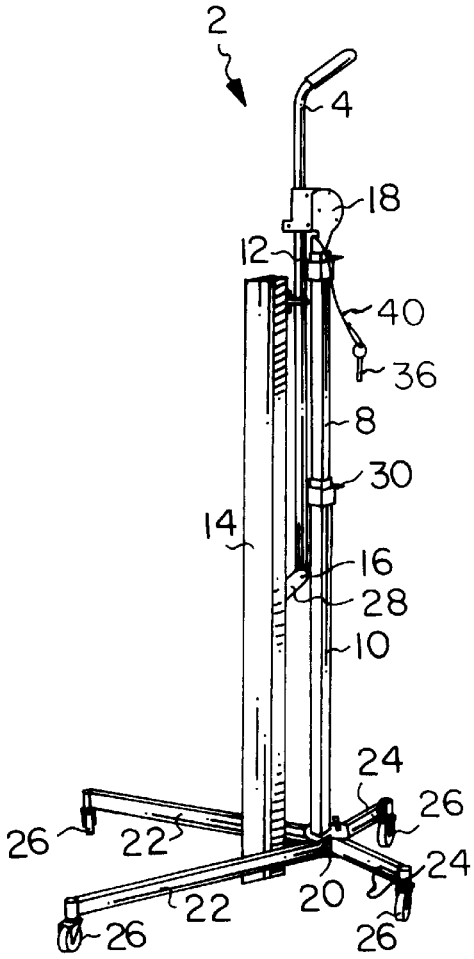

PORTABLE TASK LIGHTING DEVICE

BACKGROUND—FIELD OF INVENTION

This invention relates to portable lighting devices, specifically to a portable task lighting device which comprises a wheeled base having two elongated front legs that are each set into a singular unchanging position during use and two rotatable back legs that can be independently moved toward or away from one another prior to being set into a variety of fixed positions for use. The lighting device also has an upwardly telescoping mast centrally connected to the wheeled base which locks the front legs into their fixed usable positions, a pivot block connected to the top of the mast which comprises a plurality of positive locking positions, a boom arm connected to the pivot block, and an elongated fluorescent light assembly pivotally connected to the free end of the boom arm for a full 360° of rotation. The combination of its telescoping mast which preferably extends between approximately thirty-two and ninety inches, its pivoting boom arm, and its rotatable light assembly allows the present invention to be placed into a nearly infinite number of configurations. It is contemplated during use for the elongated light assembly to always be positioned over the front legs for maximum stability, particularly when the telescoping mast is fully extended, and for the mast to have an asymmetrical or other cross-sectional configuration so that weight of the elongated light assembly and boom arm will not cause an unexpected rotation of any one of the extended telescoping members relative to the remainder of the telescoping mast structure. Thus the task lighting device of the present invention is stable, versatile, and adjustable into a nearly infinite number of usable positions to cast a broad, glare-free, and cool flood of light upon a targeted work surface. The present invention is also configured to be quickly and easily collapsed into a compact configuration for transport or storage by the removal of one quick-release pin from the pivot block and the loosening of several quick-release clamping devices that fix the telescoping mast members and rear legs in place during use. Applications may include, but are not limited to, indoor use for a wide variety of light-sensitive work projects that for proper completion require a direct source of shadow-free lighting.

BACKGROUND—DESCRIPTION OF PRIOR ART

While many work environments have ceiling-mounted overhead lighting, the amount, type, and location of individual light fixtures connected through the ceiling of a given work area can widely vary. The installation interval and intensity of light fixtures placed in a given work area at least in part is based upon the installation cost, the average lighting needs of the people working in the area, and the available power. Therefore, often work area lighting is minimal or inadequate for special applications. When lighting in a work area is considered inadequate, people must look for additional sources of light The installation of additional overhead light fixtures can be expensive and still may not provide workers with the shadow-free direct source of light that they might need. Portable desk lamps, wall-mounted or under-the-cupboard-installed counter-top lighting, and hand-held work lights, such as trouble lights, are well known for use in providing a direct source of light. However, small desk lamps and wall-mounted light fixtures are limited in application versatility, and hand-held lights have the draw back of requiring the dedicated use of one person's hand to hold them. Also, many portable lighting devices employ incandescent or halogen bulbs that generate a tremendous amount of heat, which can be uncomfortable and also cause burns in close applications. Such lights also produce glaring spots which can cause eye strain when a worker's eyes have to continually adjust from brightly lit to dimly lit areas. For illumination of larger work areas, the lighting alternatives are more limited, and none is known to provide all of the advantages of the present invention, particularly when illumination is required for the side and underneath surfaces of an object, and when shadow-free illumination is required.

The prior art thought to be most closely related to the present invention, but which can be distinguished therefrom, is the invention disclosed in U.S. Pat. No. 5,675,417 to Ventura (1997). The Ventura invention discloses an automobile body repair light panel and a telescoping tubular support frame for use in highlighting small flaws and surface imperfections in newly painted automobiles. It comprises an elongated light source positioned for illuminating two lenses of differing colors, each having alternating light colored bands and opaque dark colored stripes. The Ventura light source has a U-shaped tubular frame that is pivotally connected to the free end of the innermost of several horizontally disposed telescoping members. The non-telescoping end of the largest of these horizontal telescoping members is connected to the midsection of the largest in diameter of three vertically disposed and nested tubular supports. While the outermost, longest, and largest in diameter of the nested vertical mast members of the present invention is connected to a four-wheeled base structure, the lower end of the innermost and longest of the three nested vertically disposed tubular supports in the Ventura invention is connected to a T-shaped base assembly. A free-castering wheel is connected to the free end of each of the three Ventura base assembly legs. Although one Ventura leg is shown to be telescoping, none of the three Ventura legs appears to be rotatable relative to the others, in a manner similar to the present invention which would allow it to be collapsible into a compact configuration for transport and storage.

In contrast, the present invention comprises a base assembly having four legs, two shorter independently rotatable ones and two longer ones which are each locked into their single stationary usable positions by the mast being placed through and secured in a hole in the upper surface of its base plate that is square or otherwise configured to prevent inadvertent rotation. Also, while two of the legs of the present invention are rotatable relative to one another, none is telescoping. Further, the three nested vertical Ventura tubes are each illustrated with a circular cross-sectional configuration and the innermost tube extends the full height of the Ventura light structure. In contrast, the present invention comprises nested mast members necessarily having a square or other non-slipping cross-sectional configuration to lock the longer front legs into their stationary usable positions and prevent one or more nested mast members from unexpectedly rotating independently of the others. In the present invention, the outermost and largest diameter mast member has the greatest length dimension, and its smallest diameter mast member is positioned for upward extension from its middle and lower mast members. The present invention also comprises a pivot block which is connected between its upper mast member and its boom arm to allow the boom arm to be raised and lowered vertically and placed in a plurality of positively locked positions both above and below the pivot block. The Ventura device has no such equivalent components. The present invention can also be distinguished from the Ventura invention, since the present invention comprises a handle connected to its pivot block in a position opposed to the boom arm and which is used to aid in the rotation and vertical adjustment of the light assembly. It is not known to have a versatile and adjustable portable task lighting device with all of the advantages of the present invention for use in casting a broad, glare-free, and cool flood of light in an infinite number of positions both above and below the top of its mast, and which can be quickly and easily collapsed into a compact configuration for transport and storage by the removal of one quick-release pin and the loosening of several quick-release clamping devices that secure the mast and movable rear legs during use.

SUMMARY OF INVENTION—OBJECTS AND ADVANTAGES

It is the primary object of this invention to provide an infinitely adjustable and versatile portable direct lighting device with a light source that is positionable both above and below the top of its mast. A further object of this invention is to provide a direct lighting device which is configured for quick and easy positioning of its boom arm and light source into a nearly infinite number of positive locking orientations. It is also an object of this invention to provide a direct lighting device which is sufficiently light in weight so as to be easily moved by a single operator from one location to another. A further object of this invention is to provide a direct lighting device which has an adjustable but stable base. It is also an object of this invention to provide a direct lighting device which can be quickly and easily collapsed into a compact configuration for transport or storage. It is a further object of this invention to provide a direct lighting device which is simple and reliable, and which can be easily and inexpensively manufactured.

As described herein, properly manufactured and positioned for use, the present invention would provide an infinitely adjustable, versatile, portable, and easily collapsible direct source of light to help workers accomplish a variety of light-sensitive tasks. Since the present invention is self-supporting, no one is required to hold the direct source of lighting during its use. Its wheels, handle, and rotatable clamp knobs make it possible to easily and rapidly place the elongated light source of the present invention into positions both above and below the top of its mast to suit specialized task lighting needs. Wheels attached to the outer ends of its four legs, and the lightweight materials contemplated for its construction, make the present invention conveniently portable. Also, when positioned approximately 90° from one another, its movable shorter rear legs help the longer stationary front legs to provide a very stable base assembly. Maximum stability is provided when the light assembly and boom arm are positioned over the longer stationary front legs. Since the mast members have an asymmetrical or other non-slipping cross-sectional configuration, they are not subject to unexpected rotation within one another which could otherwise cause a shift in the weight distribution of the present invention that could unbalance and topple it. The movable rear legs allow the configuration of the base assembly of the present invention to change according to a needed application so that the attached mast can always be placed in an optimal position relative to objects requiring shadow-free illumination. In addition, the pivot block connected between the boom arm and the upper mast member provides a simple and reliable means for securing the light assembly at a variety of differing heights and positive locking orientations. None of the components in the present invention is unduly complex, thus allowing it to be easily and cost effectively manufactured. The preferred embodiment of the present invention comprises an elongated fluorescent light assembly that casts a broad, glare-free, and cool flood of light. It is also contemplated for the mast of the present invention to be upwardly telescoping to a maximum extension of at least ninety inches. In the preferred embodiment the lower end of the mast is required to have a square configuration to lock the two front legs of the present invention into their singular stationary usable positions. Quick collapse of the present invention into a compact configuration for transport and storage can be easily accomplished by the removal of one pin and the loosening of several rotatable clamp knobs that secure the mast and rear legs during use. Although certain limited outdoor applications would be possible, the present invention is contemplated for indoor use.

The description herein provides preferred embodiments of the present invention but should not be construed as limiting the scope of the portable direct source task lighting invention. For example, variations in the number of vertically telescoping mast members used, the maximum extendible height of the mast and boom arm combination, the configuration of the handle, the number of holes through the pivot block for establishing positive locking positions for the boom arm, the configuration of the wheel assemblies attached to the front and rear legs, the number of fluorescent light bulbs used, and the materials used in construction of the handle, boom arm, legs and handle, other than those shown and described herein, may be incorporated into the present invention. Thus the scope of the present invention should be determined by the appended claims and their legal equivalents, rather than the examples given.

BRIEF DESCRIPTION OF THE DRAWINGS

FIG. 4 is a perspective view of the present invention in a second typical operational configuration with the upper and middle mast components extended, the movable rear legs separated from one another, the light source attached to the boom arm and raised into an elevated position, a pivot block connected between the boom arm and the upper mast member, and arrows showing the direction of movement of the rear legs.

FIG. 5 is a perspective view of the present invention in a third typical operational configuration with only the middle mast component extended, the movable rear legs separated from one another, the light source attached to the boom arm and lowered into a position substantially parallel to the mast, and a pivot block connected between the boom arm and the upper mast member.

DETAILED DESCRIPTION OF PREFERRED EMBODIMENTS

Figure 1:
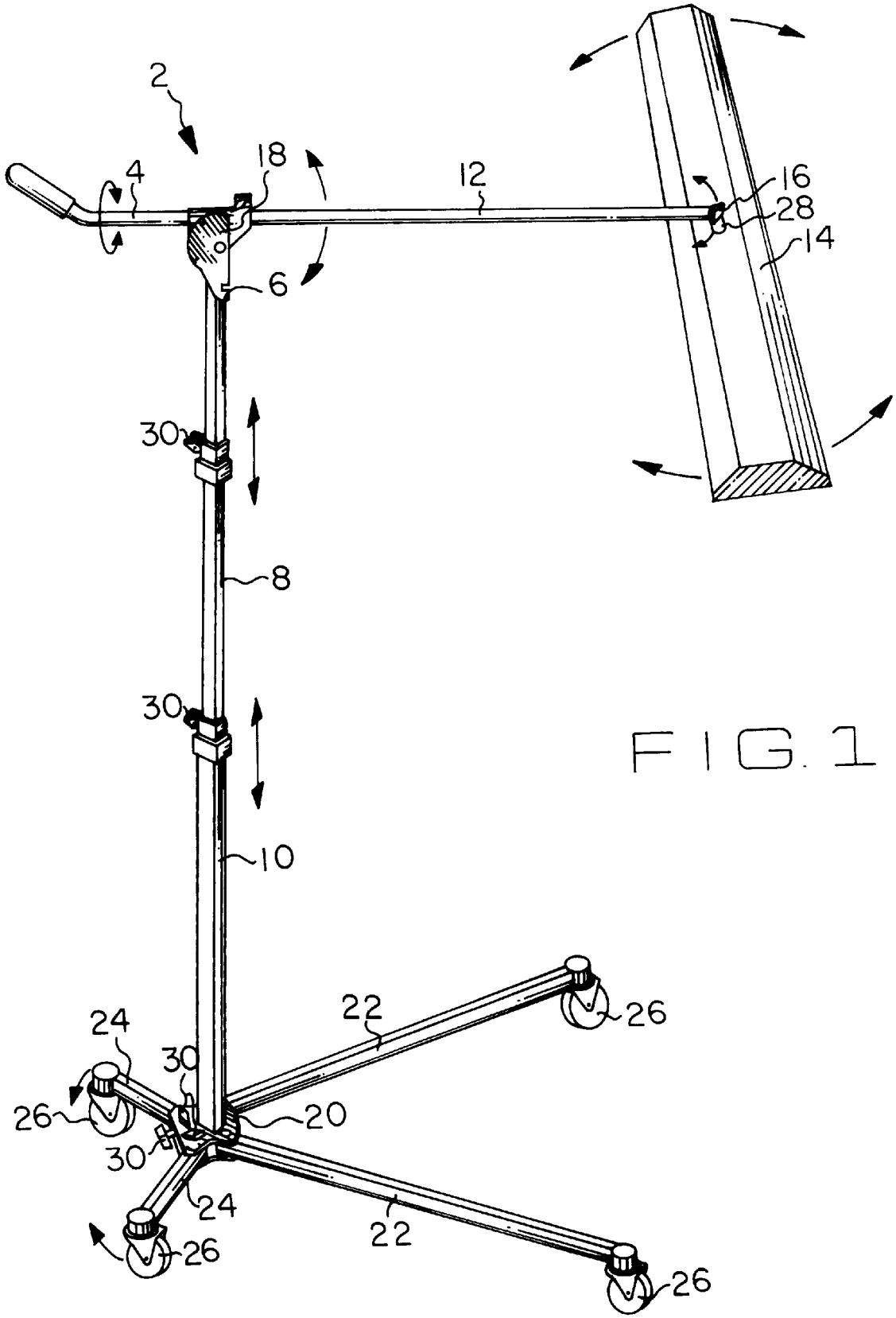
FIG. 1 is a perspective view of the present invention in a first typical operational configuration with the upper and middle mast components extended, the movable rear legs separated from one another, the light source attached to the boom arm, a pivot block connected between the boom arm and the upper mast member, and arrows showing the direction of movement of various components.

FIG. 1 shows a preferred embodiment of portable task lighting device 2 oriented into one of its many operational configurations. FIG. 1 shows lighting device 2 having an elongated light fixture 14 and a short connecting member 28 attached centrally to the back of light fixture 14. The dimension and configuration of light fixture is not critical, but at a minimum should be adequate to house at least two four foot fluorescent light bulbs, shown in FIG. 6 as number 42. FIG. 1 further shows lighting device 2 having a boom arm 12 in an essentially horizontal position with one of the ends of boom arm 12 supporting light fixture 14. It is contemplated for the connection between boom arm 12 and short connecting member 28 to be pivotal, through use of a swivel joint 16, so that light fixture can have a full 360° of rotation relative to boom arm 12. Arrows in FIG. 1 show that it is contemplated for light fixture 14 to move in an X-Y direction, as well as a Z direction. In the preferred embodiment for ease in manufacture, although not critical, it is contemplated for boom arm 12 to have a square cross-sectional configuration. The materials from which light fixture 14 and boom arm 12 are made are not critical, however, it is contemplated for such materials to be light in weight so that lighting device 2 can be easily handled by most operators (not shown).

FIG. 1 further shows the proximal end of boom arm 12 connected to a pivot block 18, with the proximal end of an elongated handle 4 also connected to pivot block 18 in a position opposed from boom arm 12 with the proximal end of handle 4 axially aligned with boom arm 12. Although not critical, it is contemplated for the free end of handle 4 to be angled relative to its attached end. Also, although not critical, the free end of handle 4 may have an ergonomic configuration and be optionally covered by a high-friction material so that an operator (not shown) can easily grip handle 4 while using it to help vertically orient boom arm 12 and securely lock boom arm 12 into a desired position for use. Handle 4 may have any configuration and dimension that allows it to be easily gripped and used, as long as it does not in any way restrict the movement of boom arm 12 and light fixture 14. FIG. 1 further shows the upper end of an upper mast member 6 connected into the bottom part of pivot block 18 so that upper mast member 6 is substantially placed in a vertical position. FIG. 1 also shows the lower end of upper mast 6 telescopingly connected within a middle mast member 8 and the lower end of middle mast 8 telescopingly connected within a lower mast member 10. It is contemplated for middle mast member 8 to be upwardly telescoping from lower mast member 10, and for upper mast member 6 to be upwardly telescoping from middle mast member 8 so that boom arm 12 can be raised from a height of approximately thirty-two inches to a height of approximately ninety inches. FIG. 1 further shows a first quick-release clamping device 30 connected between middle mast member 8 and lower mast member 10, and a second quick-release clamping device 30 connected between upper mast member 6 and middle mast member 8. Each quick-release clamping device 30 allows the next adjacent upper mast component, either middle mast member 8 or upper mast member 6, to be locked in various extended positions relative to the next lower mast component, either lower mast member 10 or middle mast member 8, respectively. It is contemplated for the knobs on quick-release clamping devices 30 to be sufficiently large for easy use by an operator's hand (not shown). Although the materials from which upper mast member 6, middle mast member 8, and lower mast member 10 are made are not critical, such materials must be sufficiently strong to support the weight of boom arm 12 and light fixture 14, yet sufficiently light in weight for lighting device 2 to be easily handled by most operators (not shown). In the preferred embodiment shown in FIG. 1, it is critical that at least the lower end of lower mast member 10 have a square configuration, however, it is generally preferred that all mast components, to include upper mast member 6, middle mast member 8, and lower mast member 10, would have a square cross-sectional configuration to minimize expense and maximize ease of manufacture. It is also critical that upper mast member 6, middle mast member 8, and lower mast member 10 each have an asymmetrical or other cross-sectional configuration to prevent inadvertent rotation of upper mast member 6 within middle mast member 8, as well as the prevention of inadvertent rotation of middle mast member 8 within lower mast member 10. Such asymmetrical or other non-slipping configuration will prevent light fixture 14 and boom arm 12 from unexpectedly rotating relative to one another and the possible causing of an unbalanced and dangerous orientation. Also, although in the preferred embodiment of lighting device 2 three telescoping mast members are used, lighting device 2 is not limited to three mast members and it is contemplated for the scope of the present invention to include both a number of telescoping mast members that is either greater or fewer than three.

Figure 2:
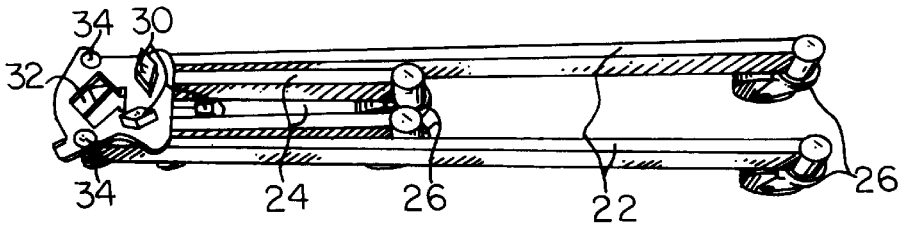
FIG. 2 is a perspective view of a collapsed base assembly of the present invention showing the compact configuration which results from the two front legs being rotated away from one another until they become folded parallel to one another and both of the rear legs.
Figure 3:
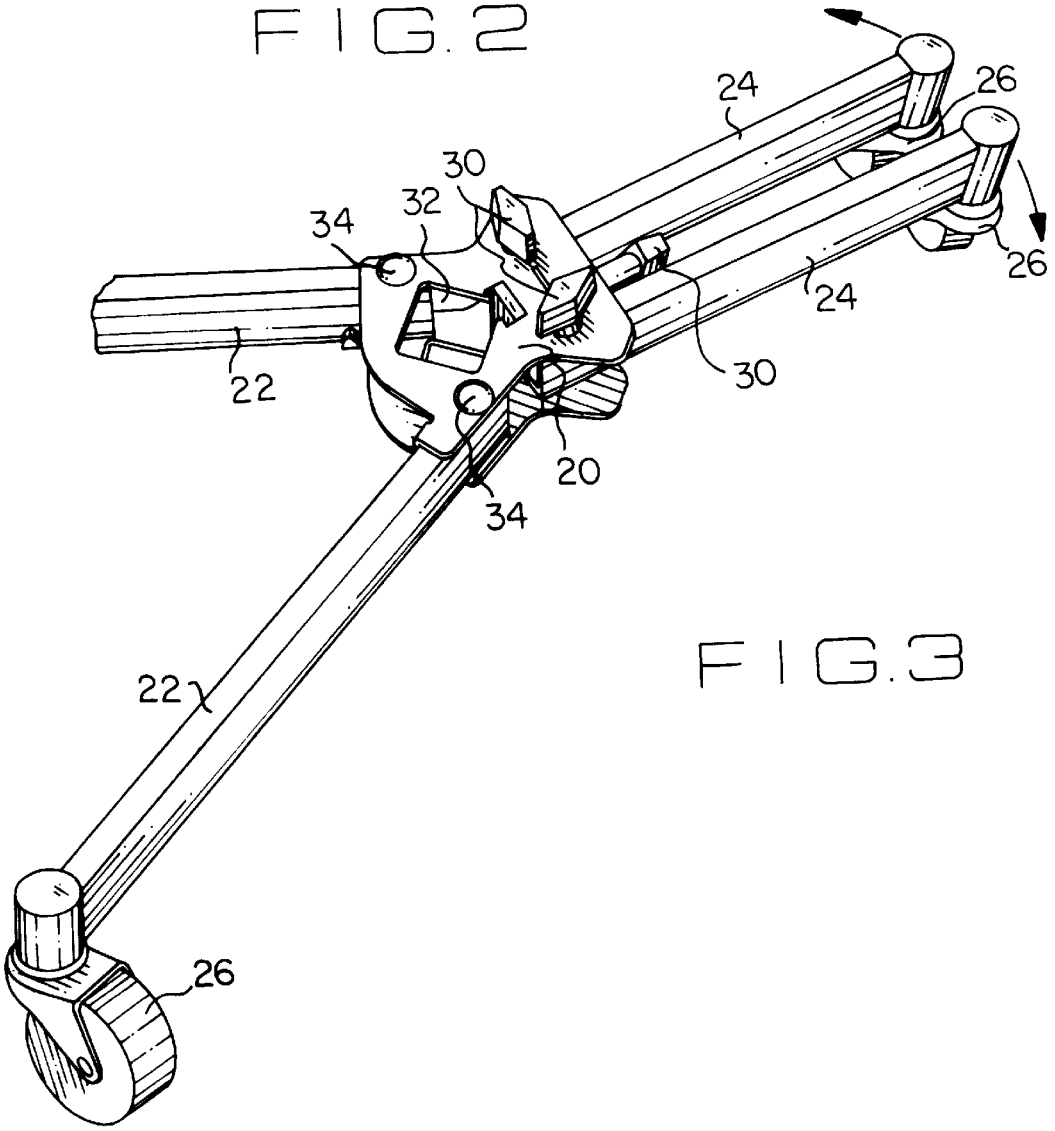
FIG. 3 is a perspective view of the base assembly of the present invention with its front legs extended into their usable and lockable stationary positions, and its rear legs positioned adjacent to one another in an approximately parallel relation, with arrows showing the intended lateral movement of the rear legs.

The lower end of lower mast member 10 is supported in an upright position by the base support structure of lighting device 2, which is also shown in more detail in FIGS. 2 and 3, and comprises a base plate assembly 20, two elongated front legs 22, two shorter rear legs 24, and four wheels 26. FIG. 1 shows one quick-release clamping device 30 securing lower mast member 10 to base plate assembly 20. Quick-release clamping device 30 is used so that lower mast member 20 can be easily and rapidly removed from base plate assembly 20 to allow lighting device 2 to be quickly placed into its compactly collapsed configuration for transport and storage. During use, the proximal end of each front leg 22 and each rear leg 24 is inserted into and supported by base plate assembly 20. The positioning of the squarely configured lower end of lower mast member 10 within a square opening, shown in FIG. 3 as number 32, that is cut through the upper surface of base plate assembly 20, secures front legs 22 into their singular stationary operating positions. For optimum stability and safety during use, lower mast member 10 is always placed within base plate assembly 20 so that light fixture 14 and boom arm 12 are positioned over longer front legs 22. An additional quick-release clamping device 30 is connected through the upper surface of base plate assembly 20 to permit the independent lateral movement and securing of each rear leg 24 into its many usable positions. FIG. 1 further shows a wheel 26 attached to the free end of each rear leg 24 and each front leg 22 so that lighting device 2 is readily portable. Although many types of wheels 26 could be suitable, in the preferred embodiment it is contemplated for wheels 16 to comprise the free-castering type of wheel illustrated in FIG. 1. Also, although not critical, for ease, expense, and continuity in manufacture it is contemplated for rear legs 24 and front legs 22 to have a square cross-sectional configuration. However, should rear legs 24 and front legs 22 be given another cross-sectional configuration, base plate assembly 20 would also have to be modified to receive the specific cross-section chosen for front legs 22 and rear legs 24. The materials from which wheels 26, rear legs 24, front legs 22, and base plate assembly 20 are made should be sufficiently strong to support the weight of the upper structure of lighting device 2, to include the weight of boom arm 12 and light fixture 14, but the selection of such materials is not otherwise critical. In the preferred embodiment it is also contemplated for such materials to be light in weight so that lighting device 2 can be easily handled by most operators (not shown). It is further contemplated for the knobs on quick-release clamping devices 30 to be sufficiently large for easy use by an operator's hand (not shown).

FIGS. 2 and 3 show the base support structure of lighting device 2 in a fully collapsed and partially collapsed configuration, respectively. FIG. 2 shows the proximal ends of two front legs 22 and two rear legs 24 each connected to base plate assembly 20. In FIG. 2, both front legs 22 and rear legs 24 are positioned approximately parallel to one another, with rear legs 24 positioned between front legs 22. One wheel 26 is attached to the distal end of each rear leg 24 and each front leg 22. FIG. 2 further shows a square opening 32 through the upper surface of base plate assembly 20, two fasteners 34 connected through the top of base plate assembly 20, and three quick-release clamping devices 30. Two of the quick-release clamping devices 30 are connected through the upper surface of base plate assembly 20, and the third quick-release clamping device 30 is shown positioned between rear legs 24. Fasteners 34 secure front legs 22 to base plate assembly 20, but do so in a manner which allows front legs 22 to be rotated nearly 180° from their fully collapsed positions. Although fasteners 34 attach front legs 22 to base plate assembly 20, fasteners 34 are not used to fix front legs 22 into their stationary usable positions. The insertion and securing of the square lower end of lower mast member 10 into square opening 32 through the upper surface of base plate member 20 alone is responsible for locking front legs 22 into their singular and stationary usable positions. The third quick-release clamping device 30, located in FIG. 2 between rear legs 24, releasably secures lower mast member 10 within square opening 32. The remaining two quick-release clamping devices 30 located through the upper surface of base plate assembly 20 are used to releasably lock rear legs 24 into various positions relative to one another. Each quick-release clamping device 30 works independently from the others, allowing each rear leg 24 to be moved independently from the other. FIG. 3 shows front legs 22 each rotated away from rear legs 24 and placed into their fully expanded and usable positions. FIG. 3 also shows rear legs 24 remaining in their fully collapsed positions and poised for movement away from one another. The usable position selected for rear legs 24 depends on the work environment and intended use for lighting device 2. For example, for indoor use on a level surface, an operator could orient rear legs 24 parallel to one another, yet when light fixture 14 placed into a position of maximum upward extension, placing rear legs 24 in a wide angle open stance would increase the overall stability of lighting device 2.

Figure 6:
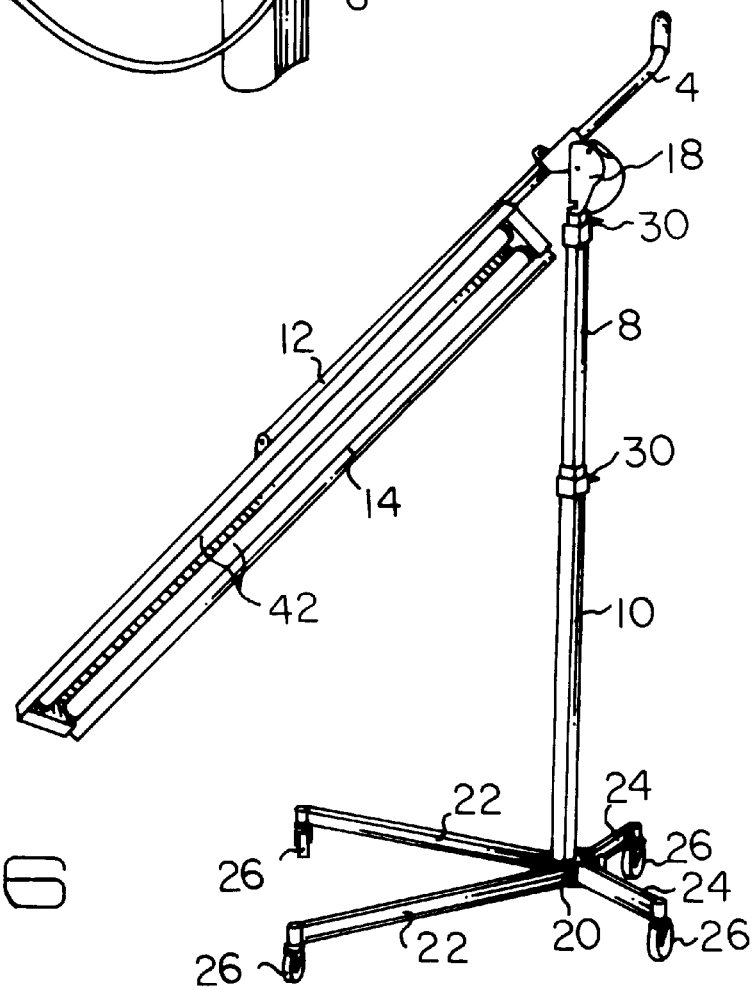
FIG. 6 is a perspective view of the present invention in a fourth typical operational configuration with only the middle mast component extended, the movable rear legs separated from one another, the light source attached to the boom arm with the boom arm placed into a partially raised less-than-horizontal position, and a pivot block connected between the boom arm and the upper mast member.

FIGS. 4, 5, and 6 show lighting device 2 in various usable positions. However, it should be remembered that with the telescoping action of upper mast member 6 and middle mast member 8, as well as the pivoting action of boom arm 12 combined with the full 360° swivel movement created for light fixture 14 through its connection to swivel joint 16, lighting device 2 can be placed into a nearly infinite number of differing configurations, of which FIGS. 4, 5, and 6 represent only three. FIGS. 4, 5, and 6 all show lighting device 2 having the proximal ends of two front legs 22 and two rear legs each connected into base plate assembly 20, a wheel 26 supporting the free end of each front leg 22 and each rear leg 24, as well as front legs 22 fixed into their stationary usable positions with rear legs 24 fixed into positions spaced apart from one another. FIGS. 4, 5, and 6 each also show light fixture 14 supported on one end of boom arm 12, with the other end of boom arm 12 connected into pivot block 18. Light fixture 14 is always positioned over longer front legs 22 when optimum balance is desired. Handle 4 also connects into pivot block 18 in all three FIGS. 4, 5, and 6, in a position opposed to the connection of boom arm 12 with the proximal end of handle 4 being axially aligned with boom arm 12. Although not critical, in each FIG. 4, 5, and 6 the distal end of handle 4 is positioned at an angle relative to boom arm 12. In all three FIGS. 4, 5, and 6 pivot block 18 is connected to the upper end of upper mast member 6, even though upper mast member 6 may be fully contracted and not visible, as in FIGS. 5 and 6. Also, in all three FIGS. 4, 5, and 6, the lower end of upper mast member 6 is telescopingly engaged to upwardly extend from middle mast member 8, and the lower end of middle mast member 8 is telescopingly engaged to upwardly extend from lower mast member 10. All three FIGS. 4, 5, and 6, show middle mast member 8 extended upwardly from lower mast member 10 and quick-release clamping devices 30 connected to the upper and lower ends of middle mast member 8. In addition, FIG. 4 shows upper mast member 6 fully extended and boom arm 6 extended into a near vertical position to upwardly extend light fixture 14 into a position of near maximum height. FIG. 4 also has arrows showing the lateral movement of rear legs 24 and the connection of short connecting member 28 to boom arm 12 through swivel joint 16. FIG. 5 further shows pin 36 removed from pivot block 18 and boom arm 12 fully lowered into a position approximately parallel to middle mast member 8 and lower mast member 10, with the lower end of light fixture 14 positioned between and lower than front legs 22. FIG. 5 also shows short connecting member 28 and swivel joint 16 connecting light fixture 14 to pivot block 18, as well as pin 36 connected to pivot block 18 through use of a lanyard 40 so that pin 36 remains in easy reach of an operator needing to change the position of boom arm 12. In contrast to FIGS. 4, and 5, FIG. 6 shows two fluorescent light bulbs 42 secured within light fixture 14. Although it is not contemplated for the present invention to be limited to two fluorescent light bulbs 42, the use of two fluorescent light bulbs 42 is preferred so as to limit the weight of lighting device 2 and keep it easily portable. FIG. 6 also shows light fixture 14 approximately parallel to boom arm 12, and both light fixture 14 and boom arm 12 spaced apart from middle mast 8 at an acute angle so that light fixture 14 and boom arm 12 remain in an orientation below pivot block 18.

Figure 7:
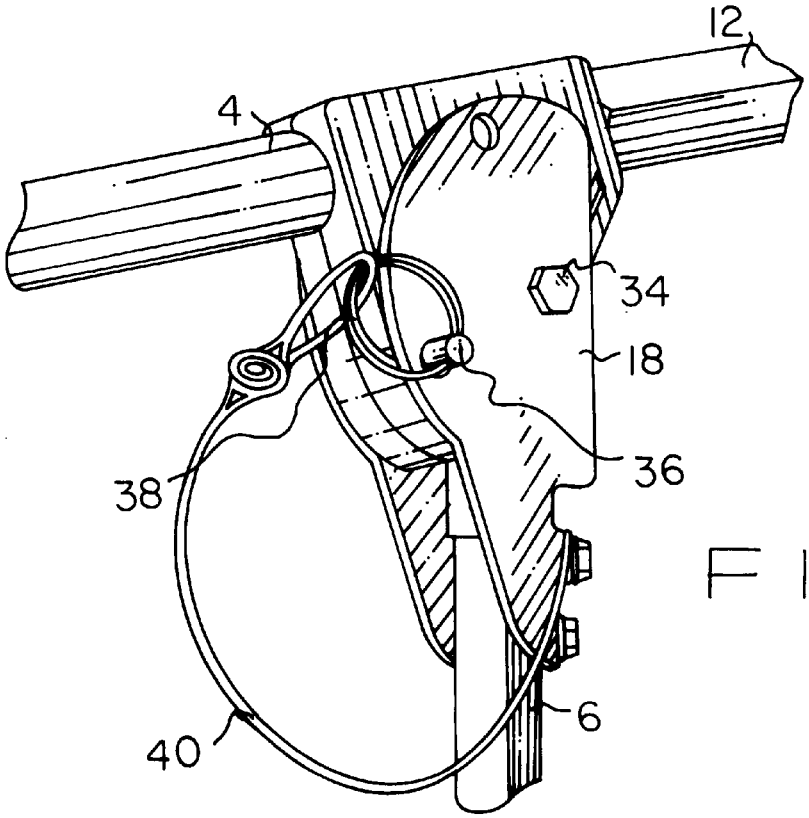
FIG. 7 is an enlarged perspective view of the pivot block of the present invention showing a quick-release pin securing the boom arm in a positive locked position.

FIG. 7 shows pivot block 18 which provides an adjustable means for attaching boom arm 12 to the upper end of upper mast member 6. As shown in FIG. 7, pivot block 18 is rigidly attached to boom arm 12, handle 4, and upper mast member 6. In the preferred embodiment it is contemplated for the outer bracket of pivot block 18 to have two holes through which quick release pin 36 can be inserted, with the inner bracket and hidden portion of pivot block 18 having five holes into which quick-release pin 36 can be inserted. Together, the five holes in the hidden inner bracket of pivot block 18 and the two holes in the outer bracket of pivot block 18 allow ten different positions in which to positively lock boom arm 12. The number and spacing of holes in pivot block 18 is not critical to its design, however, the number of holes should not be so numerous as to weaken the structure of pivot block 18. A fastener 34 connects inner and outer members of pivot block 18 to one another. FIG. 7 also shows a locking pin 36 secured through pivot block 18, a lanyard 40 also connected to pivot block 18, and a ring 38 connecting locking pin 36 to lanyard 40. The use of lanyard 40 helps to prevent the loss of locking pin 36, as well as to keep locking pin 36 easily within the reach of an operator attempting to reposition boom arm 12.

To use the preferred embodiment of lighting device 2 and starting from when lighting device 2 is in its fully collapsed position, an operator (not shown) would rotate front legs 22 laterally away from their parallel positions adjacent to rear legs 24 until front legs 22 each became braced against the interior structure of base plate assembly 20 to place them approximately into the spaced-apart stationary position they are locked into during use. In this spaced-apart stationary position, the front legs 22 of the preferred embodiment would be set at an approximate 45° angle from one another. Also, in the preferred embodiment it is contemplated that front legs 22 would each be approximately twenty-two inches in length and rear legs 24 would each be approximately ten inches in length, with each having a free-castering wheel 26 that is approximately two inches in diameter attached to its free end. However, it is within the scope of the present invention to have front legs 22, rear legs 24, and wheels 26 with dimensions other than twenty-two inches, ten inches, and two inches respectively. Depending upon the intended positioning and use of light fixture 14, the desired amount of lateral rotation away from one another is determined for rear legs 24. The quick-release clamping devices 30 attached through the upper surface of base plate assembly 20, each associated with one rear leg 24, are then loosened. The corresponding rear legs 24 are then independently moved into the appropriate position indicated by the desired positioning and environmental factors, and the quick-release clamping devices 30 associated with each rear leg 24 moved are then again tightened to secure each rear leg 24 into its desired operating position. A third quick-release clamping device 30, located between rear legs 24, is then loosened to allow insertion of the square lower end of lower mast member 10 within square opening 32 through the upper surface of base plate assembly 20.

Once the lower end of lower mast member is placed within opening 32, front legs 22 each become locked into their usable positions and can no longer be rotated laterally toward rear legs 24, until lower mast member 10 is once again separated from base plate assembly 20. The quick-release clamping device 30 engaging the lower end of lower mast member 10 would be tightened to secure lower mast member 10 into its upright position for use. Middle mast member 8 and upper mast member 6, if not already nested within lower mast member 10, would be assembled so that a quick release clamping device 30 is positioned between both lower mast member 10 and middle mast member 8, as well as between middle mast member 8 and upper mast member 6, to allow a wide variety of combinations in height adjustment of upper mast member 6 and middle mast member 8. It is within the scope of the present invention for lighting device 2 to have more than one middle mast member 8. In the preferred embodiment it is contemplated for lower mast member 10 to be approximately thirty-one inches in length and for pivot block 18 to be approximately five inches in height, with pivot block 18 being raised and lowered above the floor or ground surface (not shown) upon which wheels 26 are engaged between the approximate heights of thirty-two and ninety inches. However, it is within the scope of the present invention for lower mast member 10, as well as middle mast members 8 and upper mast member 6 to have other height dimensions to permit a different range of extension for pivot block 18, which can potentially extend beyond ninety inches. Middle mast member 8 and upper mast member 6 would then each be raised to the desired height needed for use and the corresponding quick-release clamping device 30 would be tightened to temporarily lock both middle mast member 8 and upper mast member 6 in place.

It is contemplated in the collapsed configuration of the preferred embodiment that pivot block 18 would remain connected to both upper mast member 6 and handle 4. However, handle 4 would be rotatable so that it could be stored and transported in a position where it is approximately parallel to lower mast member 10. In the preferred embodiment it is contemplated for handle 4 to be approximately 19 inches in length and have approximately one-fourth of its total length bent relative to the remainder of handle 4 at an obtuse angle thereto. It is contemplated in the collapsed configuration of the preferred embodiment for short connecting member 28 to remain attached to light fixture 14, and for boom arm 12 and short connecting member 28 to both remain attached to swivel joint 16. In the preferred embodiment it is also contemplated for boom arm 12 to be approximately two inches longer than light fixture 14. An operator (not shown) would then determine the height of light fixture 14 suitable for the intended use, employ handle 4 in placing boom arm 12 into the desired position over longer front legs 22, and lock the proximal end of boom arm 12 into the appropriately angled position against pivot block 18 with locking pin 36. In the preferred embodiment of lighting device 2, it is contemplated for the outer bracket of pivot block 18 to have two holes for insertion of locking pin 36 and for the inner bracket of pivot block 18 to have five holes for a maximum of ten positive locking height adjustment positions. However, it is within the scope of the present invention for pivot block 18 to have a different number of height adjustment positions, other than ten. To move light fixture 14 to a different location or height, the operator could use any combination of the following, apply a force directly to one end of light fixture 14 to swivel it up to 360°, apply a force directly to lower mast member 10 to move wheels 26 relative to the surface upon which lighting device 2 is supported, release locking pin 36 and use handle 4 to move boom arm 12 to a different one of the ten positive locking height adjustment positions offered by the preferred embodiment of lighting device 2, raise or lower upper mast member 6, and raise or lower middle mast member 8. After assessing the change in height and positioning of light fixture 14, one or both rear legs 24 may also need to be moved laterally relative to the other to enhance the over all stability of lighting device 2. When lighting device 2 is no longer needed for use it can be quickly and easily returned to its fully collapsed configuration for storage or transport whereby boom arm 12 is again separated from pivot block 18, upper mast member 6 and middle mast member 8 are collapsed with lower mast member 10 with handle 4 rotated into a position approximately parallel to lower mast member 10, lower mast member is separated from base plate assembly 20, rear legs 24 are each rotated toward one another into an approximately parallel configuration, and front legs 22 are rotated laterally until each is approximately parallel to rear legs 24. Although not shown, it is also contemplated for light fixture 14 to have a power cord for connection to a remote power source. If such power source in located overhead, such a power cord would be connected upwardly to reach the power source. In the alternative, if a power source were located closer to ground-level, such a power cord could be wrapped loosely about boom arm 12, lower mast member 10, and also around upper mast member 6 and middle mast member 8 if they are in extended positions, so that the power cord is maintained in an out-of-the-way position during any use of lighting device 2.

What is claimed is:

1. A portable task lighting device for providing direct shadow-free lighting to workers engaged in a variety of light-sensitive tasks, said device comprising a boom arm having opposite ends;

a fluorescent light assembly connected to one of said opposite ends of said boom arm;

swivel connection means for connecting said light assembly to said boom arm, said swivel connection means being configured to allow said light assembly to fully rotate 360° relative to said boom arm;

a pivot block configured for placement into a plurality of positive locking positions, said pivot block being connected to the other one of said opposite ends of said boom arm;

quick-release means for fixing said pivot block into a plurality of positive locking positions;

a handle having a proximal end also being connected to said pivot block in a position opposite to said boom arm;

a substantially vertical mast having a plurality of upwardly telescoping members, each of said telescoping members having a cross-sectional configuration which prevents inadvertent rotation of any of said telescoping members relative to the remainder of said telescoping members, said pivot block being connected to and supported by the uppermost one of said telescoping members;

a wheeled base assembly having sufficient dimension and configuration for stable support of said mast, said boom arm, and said light assembly in fully extended positions, and which is easily collapsible into a compact configuration for transport and storage, said base assembly also having two elongated front legs, two movable rear legs, and an upper surface with an opening configured to receive said mast and whereby presence of said mast within said opening locks each of said front legs into a stationary usable position; and a plurality of quick-release clamping devices configured for fixing said telescoping members and said rear legs, respectively, into locked positions relative to one another during use;

whereby said lighting device can be adjustable into a nearly infinite number of usable configurations with said light assembly being positioned both above and below said pivot block.

2. The lighting device of claim 1 wherein said quick-release means for fixing said pivot block comprises a plurality of holes through said pivot block and a locking pin configured and dimensioned for secure positioning within said holes.

3. The lighting device of claim 1 wherein said wheel assemblies each comprise a free-castering wheel.

4. The lighting device of claim 1 wherein said telescoping members comprise one lower mast member, one middle mast member, and one upper mast member.

5. The lighting device of claim 4 wherein said lower mast member has a square cross-sectional configuration and said base assembly comprises a base plate member having an upper surface and a square opening through said upper surface, four wheel assemblies, said two movable rear legs each having a distal end and a proximal end, which are laterally adjustable relative to one another, one of said wheel assemblies supporting each of said distal ends of said rear legs and each of said proximal ends of said rear legs being connected to said base plate member, and said base assembly also comprising said two elongated front legs each having a distal end and a proximal end, one of said wheel assemblies also supporting said distal end of each of said front legs and each of said proximal ends of said front legs being connected to said base plate member, said proximal end of each of said front legs becoming locked into a stationary usable position at a predetermined angle from one another by insertion of said lower mast member within said square opening in said base plate member.

6. The lighting device of claim 4 wherein said boom arm, said handle, said upper mast member, said middle mast member, said lower mast member, said front legs, said rear legs, and said light fixture are all made from lightweight materials so as to make said lighting device more readily portable.

7. The lighting device of claim 1 wherein said handle has a length dimension approximately one-third of said boom arm for ease in adjusting said boom arm relative to said mast.

8. The lighting device of claim 1 wherein said light assembly has adequate dimension to house at least two fluorescent light bulbs each having a length of approximately four feet.

9. A portable task lighting device for providing direct shadow-free lighting to workers engaged in a variety of light-sensitive tasks, said device comprising an elongated boom arm having opposite ends;

an elongated fluorescent light assembly configured for casting a broad, glare-free, and cool flood of light, said light assembly being rotatably connected to one of said opposite ends of said boom arm;

swivel connection means for connecting said light assembly to said boom arm, said swivel connection means being configured to allow said light assembly to fully rotate 360° relative to said boom arm;

a pivot block configured for placement into a plurality of positive locking positions, said pivot block being connected to the other one of said opposite ends of said boom arm;

quick-release means for fixing said pivot block into a plurality of positive locking positions;

an elongated handle having a proximal end also connected to said pivot block in a position opposite to said boom arm, said proximal end of said handle being axially aligned with said boom arm;

a mast having a plurality of upwardly telescoping members, each of said telescoping members having a square cross-sectional configuration, said pivot block being connected to and supported by said mast;

a base assembly with a base plate member having an upper surface and a square opening through said upper surface, four wheel assemblies, two elongated front legs each also having a distal end and a proximal end, one of said wheel assemblies supporting said distal end of each of said front legs and each of said proximal ends of said front legs being connected to said base plate member, said proximal end of each of said front legs being locked into a stationary position at a predetermined angle from one another by insertion of said mast within said square opening in said base plate member, said base assembly also having two rear legs each with a distal end, a proximal end, and a length dimension shorter than the length dimension of said front legs, said rear legs being laterally adjustable relative to one another, also one of said wheel assemblies supporting each of said distal ends of said rear legs and each of said proximal ends of said rear legs being connected to said base plate member; and a plurality of quick-release clamping devices configured for fixing said telescoping members and said rear legs, respectively, into locked positions relative to one another during use;

whereby said lighting device can be adjustable into a nearly infinite number of usable configurations with said light assembly positioned both above and below said pivot block, and whereby said lighting device can also be quickly, easily and reversibly changed from said usable configurations into a fully collapsed configuration wherein said boom arm is separated from said pivot block and said light assembly is placed into a position approximately parallel to said boom arm, said base plate member is separated from said mast with said rear legs and said front legs in positions approximately parallel to one another, said telescoping members are fully nested together, and said handle is rotated into a position approximately parallel to said mast.

10. The lighting device of claim 9 wherein said quick-release means for fixing said pivot block comprises a locking pin and a plurality of holes through said pivot block.

11. The lighting device of claim 9 wherein said telescoping members comprise one lower mast member, one middle mast member, and one upper mast member.

12. The lighting device of claim 11 wherein said boom arm, said handle, said upper mast member, said middle mast member, said lower mast member, said front legs, said rear legs, and said light fixture are all made from lightweight materials so as to make said lighting device more readily portable.

13. The lighting device of claim 9 wherein said wheel assemblies each comprise a free-castering wheel.

14. The lighting device of claim 9 wherein said handle has a length dimension approximately one-third of said boom arm for ease in adjusting said boom arm relative to said mast.

15. The lighting device of claim 9 wherein said light assembly is sufficiently large so as to house at least two fluorescent light bulbs each having a length of approximately four feet.

16. A method for providing cool hands-free and shadow-free task lighting in a nearly infinite number of stable positions for close application work, said method comprising the steps of providing a fluorescent light fixture, a boom arm, an elongated handle, a pivot block, an upwardly telescoping mast, a swivel joint, a quick-release pin, a plurality of quick release clamping devices, and a base plate with an upper opening, two attached elongated front legs, and two attached shorter rear legs;

rotating said front legs laterally away from said rear legs until said front legs each became braced against the interior structure of said base plate;

tightening one of said quick-release clamping devices through the upper surface of said base plate to lock the first of said rear legs in a desired position for use;

independently tightening a second one of said quick-release clamping devices through said upper surface of said base plate to also lock the second of said rear legs in a desired position for use;

placing the lower end of said mast through said opening in said base plate to lock each of said front legs into a stationary usable position;

tightening one of said quick-release clamping devices through said base plate to lock said mast into a substantially vertical position;

attaching the lower end of said pivot block to the upper end of said mast;

connecting one end of said boom arm to said pivot block;

connecting said handle to said pivot block in a position opposed to and axially aligned with said boom arm;

using said quick-release pin to lock said pivot block into one of a plurality of positive locking positions;

connecting said swivel joint to the other end of said boom arm;

connecting said fluorescent light fixture to said swivel joint for a full 360° of rotation; and manipulating varying combinations of said handle, said swivel joint, said mast, said pivot block, and said clamping devices to successively move said boom arm and said fluorescent light fixture in X, Y, and Z directions up to a maximum vertical extension of approximately ninety inches for optimal shadow-free illumination of selected work objects.

17. The method of claim 16 wherein said step of providing further comprises the steps of providing a fluorescent light fixture having two fluorescent light bulbs each with a length dimension of approximately four feet, the steps of further providing a plurality of free-castering wheels and attaching one of said free-castering wheels to each of said front legs and each of said rear legs, wherein said step of providing an upwardly telescoping mast further comprises the step of providing an upwardly telescoping mast which has three nested telescoping members, and wherein said step of providing an elongated handle further comprises the step of providing an elongated handle which has a length dimension approximately one-third the length of said boom arm.

* * * * *